US007887713B2

(12) United States Patent
Hesse

(10) Patent No.: US 7,887,713 B2
(45) Date of Patent: Feb. 15, 2011

(54) METHOD FOR PRODUCING AN ELECTRONIC COMPONENT

(75) Inventor: Christian Hesse, Deutschlandsberg (AT)

(73) Assignee: EPCOS AG, Munich (DE)

( * ) Notice: Subject to any disclaimer, the term of this patent is extended or adjusted under 35 U.S.C. 154(b) by 96 days.

(21) Appl. No.: 10/542,974

(22) PCT Filed: Dec. 23, 2003

(86) PCT No.: PCT/DE03/04289

§ 371 (c)(1),
(2), (4) Date: Jan. 24, 2006

(87) PCT Pub. No.: WO2004/068508

PCT Pub. Date: Aug. 12, 2004

(65) Prior Publication Data

US 2006/0131274 A1 Jun. 22, 2006

(30) Foreign Application Priority Data

Jan. 24, 2003 (DE) ..... 103 02 800

(51) Int. Cl.
*C23F 1/00* (2006.01)

(52) U.S. Cl. ..... 216/86; 216/90

(58) Field of Classification Search ..... 216/83, 216/86, 90; 438/745, 752, 753, 756, 757
See application file for complete search history.

(56) References Cited

U.S. PATENT DOCUMENTS 3,839,110 A * 10/1974 Shankoff ..... 216/108
3,860,465 A 1/1975 Matzner et al.
4,294,648 A 10/1981 Brede et al.
5,592,140 A 1/1997 Tokunaga et al. ..... 338/21
6,166,620 A 12/2000 Inuzuka et al. ..... 338/309
6,172,592 B1 * 1/2001 Inoue et al. ..... 338/22 R
6,337,552 B1 1/2002 Inoue et al.
6,475,604 B1 * 11/2002 Fujii et al. ..... 428/209
6,522,237 B1 * 2/2003 Ito et al. ..... 338/22 R
7,245,479 B2 * 7/2007 Kobayashi et al. ..... 361/523
2002/0003557 A1 * 1/2002 Miyakoshi et al. ..... 347/58
2002/0011919 A1 * 1/2002 Ito et al. ..... 338/23
2002/0089065 A1 * 7/2002 Fujimoto et al. ..... 257/777
2003/0112116 A1 * 6/2003 Fujimoto et al. ..... 336/200

FOREIGN PATENT DOCUMENTS

CN 1105473 A 7/1995

(Continued)

OTHER PUBLICATIONS

Examination Report dated Jun. 6, 2008 from corresponding CN application 200380109168.6.

(Continued)

*Primary Examiner*—Nadine G Norton
*Assistant Examiner*—Mahmoud Dahimene
(74) *Attorney, Agent, or Firm*—Fish & Richardson P.C.

(57) ABSTRACT

A method includes forming a first electrode and a second electrode on a base body. The Method also includes chemically etching at least a portion of the base body to adjust a resistance of the base body measured between the first electrode and the second electrodes to a predetermined value.

13 Claims, 1 Drawing Sheet

FOREIGN PATENT DOCUMENTS

| | | | |
|---|---|---|---|
| CN | 1229515 | A | 9/1999 |
| CN | 1274737 | A | 11/2000 |
| DE | 29 08 361 | | 9/1980 |
| DE | 241 326 | | 12/1986 |
| DE | 257 895 | | 6/1988 |
| DE | 37 08 832 | | 9/1988 |
| DE | 38 13 627 | | 3/1997 |
| DE | 196 40 127 | | 4/1998 |
| DE | 198 00 196 | | 7/1999 |
| DE | 100 05 800 | | 2/2001 |
| EP | 1 237 164 | | 9/2002 |
| JP | 9-232103 | | 9/1997 |
| JP | 10199707 | | 7/1998 |
| WO | WO98/13836 | | 4/1998 |

OTHER PUBLICATIONS

Examination Report, Chinese Patent Application No. 200380109168.6 dated Sep. 25, 2009, no translation provided; Decision on Rejection English version, 9 pages.

* cited by examiner

METHOD FOR PRODUCING AN ELECTRONIC COMPONENT

TECHNICAL FIELD

PRIORITY CLAIM

This application is a 371 of PCT/DE03/04289 that was filed on Dec. 23, 2003, which claims priority from a German patent application No. 103 02 800.5 filed on Jan. 24, 2003.

The invention relates to a method for the manufacture of an electrical device, which has a base body as well as two external electrodes opposite each other.

BACKGROUND

Electroceramic devices, for example NTC thermistors are needed in large quantities with a very tight tolerance of ohmic resistance. Methods for the manufacture of such devices are known in which a plurality of such devices are manufactured having different resistance values. The devices having a resistance value within a given tolerance are found by electrical measurement and subsequently separated from the rest of the devices.

This method has the disadvantage that a relatively large amount of scrap has to be accepted.

To lower this scrap rate it is known furthermore to manufacture NTC thermistors in which the devices are adjusted to a target resistance by mechanical removal of portions of the basic ceramic material as well as if necessary the external electrodes. This method however has the disadvantage that for very small versions, for example Type 0402 with the dimensions 1 mm×0.5 mm×0.5 mm, this is either not possible or only at very large cost.

SUMMARY

It is the object of the present invention to specify a method for the manufacture of devices in which compliance with a pre-set electrical resistance tolerance is possible also for small volume devices.

This object is solved by means of a method according to claim 1. Advantageous embodiments of the method are to be gathered from the other claims.

A method for the manufacture of a device is specified that includes the following steps:

(a) Formation of a base body with two external electrodes lying opposite each other (b) Adjustment of the measured resistance of the base body between the external electrodes to a given target value by means of chemical etching of portions of the base body.

The method described has the advantage that by relinquishment of mechanical cutting methods, doing without for example grinding, rasping or planning, it makes available a simple and, from the standpoint of apparatus, low cost method for carrying out the manufacture of devices with a given target value for the electrical resistance. The indicated method additionally has the advantage that it is especially suitable for the manufacture of devices having very small volume, where a mechanical machining of the base body would necessitate large expenditure of time and apparatus.

By means of the method of chemically etching away portions of the base body the current path available for current flow between the oppositely lying external electrodes is narrowed whereby the electrical resistance increases.

In this method it is advantageous if the base body manufactured in the process step (a) has an actual resistance which is below the target resistance. Only in this case can the initial resistance be successfully adjusted to the target resistance by etching away portions of the base body.

In an embodiment of the method a base body is used that contains a ceramic material. This has the advantage that in a plurality of applications needed electro-ceramic devices, surface-mountable NTC thermistors or similar devices can be simply and cheaply manufactured.

In another embodiment of the method a ceramic material can also be used whose resistance has a negative temperature coefficient. Thereby the manufacture of NTC thermistors is possible.

For example, for NTC thermistors, nickel-manganese spinels of the formula $Ni^{II}_{1-z}[Mn^{III}_{2}\ Mn^{II}_{z}]O_4$, where $0 \leqq z \leqq 0.4$ can be the materials used.

It is moreover advantageous to carry out the process with base bodies whose smallest dimension is less than 3 mm. This embodiment of the method has the advantage that it makes possible the processing or the tailoring of resistance values for very small devices, where a mechanical machining would only be possible at large expense.

Especially advantageous is that the method can be carried out in which the base body is immersed in an etching liquid. This procedure has the advantage that the removal of material from the base body is carried out essentially uniformly so that massive damage to one or a few particular locations can be avoided. Furthermore, the procedure described has the additional advantage that a plurality of base bodies can be treated at the same time in a single process step.

As etching liquid sulfuric acid can for example be used.

In another embodiment of the invention, dry etching can also be carried out.

In a further embodiment of the method, the exact value of the resistance can be measured before step (b). This procedure has the advantage that a control mechanism for the etching away can be made available. From the deviation between the actual and the desired value of the resistance that conclusions regarding the etching process may be drawn.

For example it is possible to determine a duration for the etch process, for example in an etching liquid by determining the difference between the target value of the resistance and the actual value. For this purpose relationships between the etch duration and the resultant increase in resistance are determined for a particular device type. By means of the data obtained, based on measurement of the actual resistance and the difference between that and the target resistance, a previously set etch time can be determined.

After etching the base body for the previously set etch time the resistance of the device then lies sufficiently close to the target value. The measurement of the resistance before starting step (b) of the method can advantageously be in order to detect whether with the help of etching adjustment of the resistance can indeed be carried out. This would for example not be possible if in the manufacture of the base body such large tolerances occur that even after manufacture the resistance of the device is larger than the target value. In this case etching of the base body could not lead to any further adjustment to the target value, since by etching of the base body the resistance can only be increased and not however decreased.

In another embodiment of the method it can also be provided for to measure the resistance of the device or of the base body during the etching process, whereby direct control of the etching process can occur. The etching process is then stopped as soon as the resistance of the base body has reached the target value.

In the following the invention is further explained by means of embodiment examples and the related figures.

DETAILED DESCRIPTION

Figure 1:
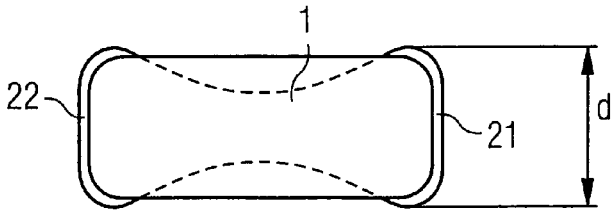
FIG. 1 shows an electrical device in schematic cross-section before and after the etching.

FIG. 1 shows an NTC thermistor with a base body 1, which comprises the NiMn spinel ceramic material, or consisting of another similarly suitable material. External contacts 21, 22 are attached to oppositely facing side surfaces of the base body 1. By etching away parts of the base body, the current path between external contacts 21, 22 is narrowed down, as shown by the dotted lines. Thereby the resistance of the device climbs. By etching the base body it is thus possible to increase the device resistance with sufficient accuracy so that a target resistance is reached. The device in FIG. 1 corresponds to type 0603 which means that the device has the following dimensions: 1.6 mm×0.8 mm×0.8 mm. Thereby the smallest dimension d in the example of FIG. 1 is the height of the base body 1, which amounts to 0.8 mm. Alternatively, one of the length, the depth the width and the diameter can be considered as smallest dimensions of devices. It is especially advantageous for the method described here to use devices whose smallest dimension is 3 mm.

During the etching, the measurement of resistance can be omitted in that through the calibrating measurement the relationship between the resistance of the device and the duration of etching is fixed. In this case, the determination of the actual resistance of the device and the determination of the difference between the actual resistance and the target resistance is sufficient. From this resistance difference then the etching duration can be calculated by means of the calibration curve.

It is advantageous if the external contacts (21, 22) are made from a material that is not attacked by the etching solution or is attacked significantly less than the ceramic material so that the solderability remains unchanged. One can consider use of a 3-layer metallization with a Ag/Ni/Sn layer sequence or a silver/palladium metallization.

Figure 2:
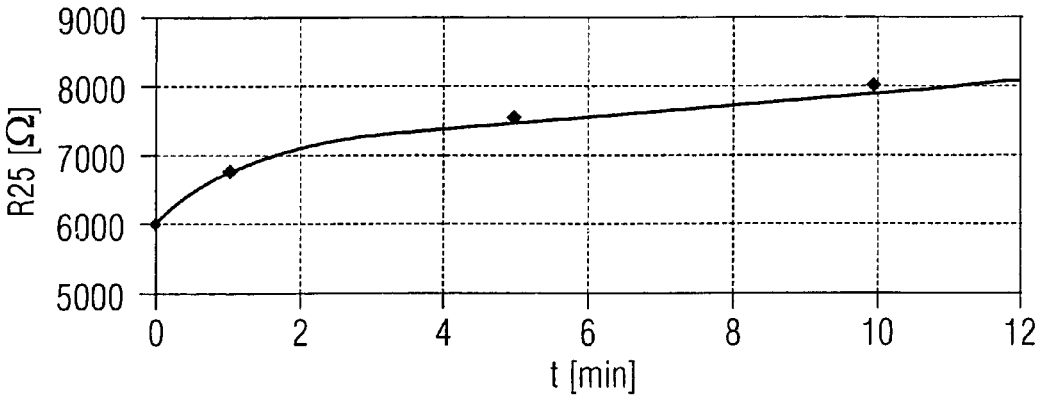
FIG. 2 shows the relationship between etch duration and the resistance increase achieved thereby for an NTC thermistor

FIG. 2 shows such a calibration curve for a device of type 0603 having a resistance R25, measured at 25° C., of 6000Ω. In FIG. 2 it is the resistance measured in Ω over the etch duration t measured in minutes. As etch solution 10% sulfuric acid was used. FIG. 2 shows measurement points measurement times of 0, 1, 5 and 10 minutes. It is clear that the resistance R25 increases with increasing etch time.

The present invention is not limited to NTC thermistors, but can be applied to any desired electrical component whose resistance is dependent on the geometric dimensions of its base body.

The invention claimed is:

1. A method comprising:

forming a first electrode and a second electrode made from a first material on a base body made from a second material; and immersing the base body, the first electrode, and the second electrode in an etching solution directly after having formed the first and the second electrode on the base body, wherein upon immersion at least a portion of the base body is chemically etched and wherein a resistance of the base body between the first electrode and the second electrode is adjusted;

wherein the first material is etched by the etching solution, and wherein the first material is etched substantially less than the second material.

2. The method of claim 1, wherein the base body comprises a ceramic material.

3. The method of claim 1, wherein the base body comprises a material having a resistance with a negative temperature coefficient.

4. The method of claim 1, wherein a length of an edge of the base body is less than about 3 mm.

5. The method of claim 1, wherein the etching solution is sulfuric acid.

6. The method of claim 1, further comprising measuring a value of a resistance of the base body prior to chemically etching the at least a portion of the base body.

7. The method of claim 1, further comprising:

determining a difference between the predetermined value and a measured value of the resistance; and determining a duration for the chemically etching based on said difference, wherein chemically etching at least a portion of the base body comprises chemically etching at least a portion of the base body for the duration.

8. The method of claim 1, wherein forming the first electrode and the second electrode on the base body comprises forming the first electrode at a location opposite the second electrode on the base body.

9. The method of claim 1, wherein chemically etching at least a portion of the base body to adjust the resistance of the base body comprises chemically etching at least a portion of the base body to adjust the resistance of the base body to a predetermined value.

10. The method of claim 1, wherein the first and second electrodes comprise a multilayer metallization comprising a Ag/Ni/Sn layer sequence.

11. The method of claim 1, wherein the first and second electrodes comprise a silver/palladium metallization.

12. A method comprising:

forming a first electrode and a second electrode on a base body; and immersing the base body, the first electrode, and the second electrode in an etching solution directly after having formed the first and the second electrode on the base body, wherein upon immersion at least a portion of the base body is chemically etched and wherein a resistance of the base body between the first electrode and the second electrode is adjusted, wherein the first and second electrodes comprise a multilayer metallization comprising a Ag/Ni/Sn layer sequence, and wherein the first and second electrodes are etched by the etching solution, and wherein the first and second electrodes are etched substantially less than the base body is etched.

13. A method comprising:

forming a first electrode and a second electrode on a base body; and immersing the base body, the first electrode, and the second electrode in an etching solution directly after having formed the first and the second electrode on the base body, wherein upon immersion at least a portion of the base body is chemically etched and wherein a resistance of the base body between the first electrode and the second electrode is adjusted;

wherein the first and second electrodes comprise a silver/palladium metallization, and wherein the first and second electrodes are etched by the etching solution, and wherein the first and second electrodes are etched substantially less than the base body is etched.

* * * * *